US007950922B2

(12) United States Patent
Hatton

(10) Patent No.: US 7,950,922 B2
(45) Date of Patent: May 31, 2011

(54) PORTAL FRAME DESIGN KILN

(75) Inventor: Philippe Hatton, Palaiseau (FR)

(73) Assignee: CERIC, Paris (FR)

( * ) Notice: Subject to any disclaimer, the term of this patent is extended or adjusted under 35 U.S.C. 154(b) by 534 days.

(21) Appl. No.: 11/861,499

(22) Filed: Sep. 26, 2007

(65) Prior Publication Data

US 2008/0076085 A1 Mar. 27, 2008

(30) Foreign Application Priority Data

Sep. 27, 2006 (FR) ..... 06 08498

(51) Int. Cl.
*F27D 1/18* (2006.01)

(52) U.S. Cl. ..... 432/237; 432/192; 432/250; 110/331; 110/332

(58) Field of Classification Search ..... 432/145, 432/65, 150, 62, 22, 237, 250, 128, 144, 432/206, 207, 200, 258, 252, 64, 158, 192; 211/41.18; 110/331, 336, 332; 52/455, 660
See application file for complete search history.

(56) References Cited

U.S. PATENT DOCUMENTS

| | | | | | |
|---|---|---|---|---|---|
| 2,255,617 | A | * | 9/1941 | Hoak | 432/22 |
| 2,634,694 | A | * | 4/1953 | Hazen | 110/331 |
| 3,045,616 | A | * | 7/1962 | Reich | 110/332 |
| 3,240,173 | A | * | 3/1966 | Bunge | 110/332 |
| 3,589,316 | A | * | 6/1971 | Longenecker | 110/332 |
| 3,789,780 | A | * | 2/1974 | Longenecker | 110/336 |
| 4,413,572 | A | * | 11/1983 | Musser | 110/331 |
| 4,474,497 | A | * | 10/1984 | Sullivan | 432/76 |
| 4,493,641 | A | | 1/1985 | Hubbert | |
| 5,062,249 | A | * | 11/1991 | Smagner | 52/320 |
| 5,357,540 | A | * | 10/1994 | Merkle et al. | 373/73 |
| 6,427,610 | B1 | * | 8/2002 | Coates et al. | 110/339 |

FOREIGN PATENT DOCUMENTS

FR 2834549 7/2003

* cited by examiner

*Primary Examiner* — Gregory A Wilson
(74) *Attorney, Agent, or Firm* — Young & Thompson

(57) ABSTRACT

A portico furnace includes a number of porticos (1), which are arranged parallel to one another and which define the spans of the furnace, and supports (2, 6) that are attached to the porticos (1), between which are positioned interjoists (3) that constitute the walls of the furnace. At least some of the interjoists (3) consist of a chimney block (4) with an axis that is parallel to the supports (2, 6).

17 Claims, 2 Drawing Sheets

PORTAL FRAME DESIGN KILN

CROSS-REFERENCE TO RELATED APPLICATIONS

The present Application incorporates by reference and claims priority to French Application 06 08498 filed Sep. 27, 2006.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION (1) Field of the Invention

In a general manner, this invention relates to the kilns that are used for firing products such as earthenware or ceramic products.

(2) Description of Related Art

These kilns usually come in the form of a tunnel of great length through which pass carriages bearing the products to be fired.

A circulation of fluid, air or any other suitable gas creates a gas stream that ensures the ventilation and the heating of the products for the purpose of their firing. The temperature, the hygrometric degree, and the displacement speed of the gas stream are continuously monitored so as to ensure a good-quality treatment of the products to be fired. In the usual manner, said gas stream enters the chamber by passing through wells or slots made in the wall of the latter, in the roof or in the lateral walls. Means, such as fans, are mounted in the ventilation circuit, usually outside of the chamber, to ensure the circulation of the gas stream.

The problem that arises in these chambers is tied to the fact that it is very difficult to obtain a uniform circulation of the gas stream around each of the products that are present in the chamber.

Numerous proposals have been made so as to improve the circulation of the gas stream by adding fans, deflectors, . . . but none have been totally satisfactory.

BRIEF SUMMARY OF THE INVENTION

This invention aims to propose a device that is designed to cause a gas to circulate in a firing kiln, whereby said device is more particularly suited to being used in tunnel kilns, which are usually referred to as portal frame design kilns. These kilns derive their name from portal frames in the shape of inverted U's, consisting of a horizontal beam and two feet, arranged beside one another to form an external frame of the tunnel kiln that is designed to hold up the elements that constitute the chamber of the kiln.

The portal frames that are placed outside of the kiln, above the upper wall of the latter, consist of metal sections.

Supports that are designed to attach the refractory wall of the kiln are held up by said portal frames.

In the roof of the portal frame design kilns, suspension parts, held up by the horizontal beam of each portal frame, constitute a support that is similar to a small beam that is shaped overall like an inverted T arranged horizontally. Interjoists are positioned perpendicularly to said supports, resting on the opposite heels of two supports that are close to one another.

The lateral walls of the kiln are made in a similar manner by supports that are attached to the feet of the portal frames between which interjoists are positioned.

An insulating coating is put on the faces of the interjoists which are outside of the chamber of the kiln to reduce the losses of heat toward the outside from the useful space, or laboratory, of the kiln.

The suspension parts and the interjoists are made of, for example, refractory materials.

According to the invention, the portal frame design kiln, which is of the type comprising a number of portal frames arranged parallel to one another and defining spans of the kiln and supports that are attached to said portal frames between which interjoists that constitute the walls of the kiln are positioned, is characterized in that at least some of the interjoists consist of a chimney block which axis is parallel to said supports.

The kiln according to the invention is also noteworthy in that:

- Said chimney blocks are positioned beside one another in a span and constitute a transverse and/or vertical pipe extending parallel to said supports,
- The pipe extends over at least a portion of the length of the supports between which it is positioned,
- A transverse pipe is connected to at least one vertical pipe,
- The chimney block has, viewed overall, a rectangular cross-section,
- Said chimney blocks are of different types, for example chimney-block-fan, distribution chimney block, end chimney block, simple chimney block, flap chimney block, . . . .
- A distribution chimney block comprises at least one seal that is arranged before an orifice,
- A corner chimney block ensures the connection between a transverse pipe and a vertical pipe.

The invention also relates to a process for ventilation of a portal frame design kiln according to the invention, characterized in that:

- Transverse and/or vertical pipes are formed in at least some of the spans of the kiln by positioning interjoists in the form of a chimney block,
- A gaseous fluid is circulated between the chamber of the kiln and said transverse and/or vertical pipes.

The process for ventilating a portal frame design kiln according to the invention is also noteworthy in that:

- A predetermined circulation of the gaseous fluid is obtained by selecting the chimney blocks that are designed to constitute each pipe from among a family that comprises, for example, chimney-block-fans, distribution chimney blocks, end chimney blocks, simple chimney blocks, flap chimney blocks, corner chimney blocks, . . . ,
- At least some of the transverse and/or vertical pipes are connected to external fluid distribution means.

BRIEF DESCRIPTION OF THE SEVERAL VIEWS OF THE DRAWINGS

The invention will be better understood using the following description that is provided by way of nonlimiting example with reference to the accompanying drawings, in which.

DETAILED DESCRIPTION OF THE INVENTION

Figure 1:
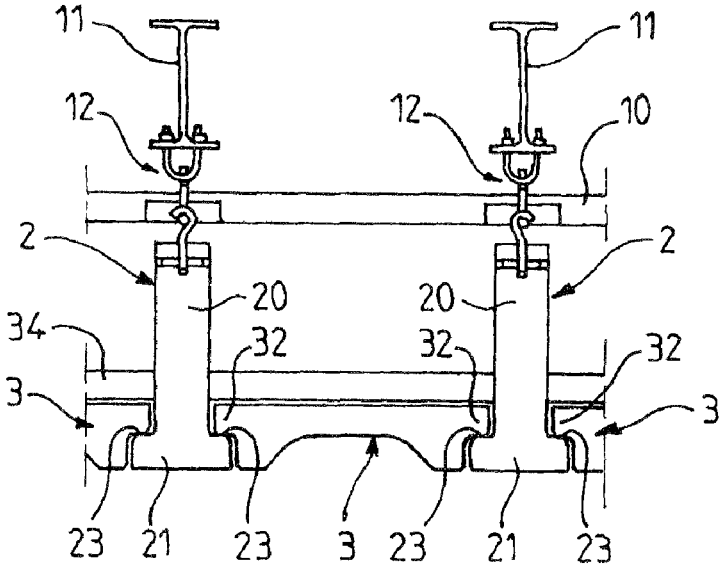
FIG. 1 is a partial cutaway view of the roof of a portal frame design kiln, limited to one span overall.

As shown in FIG. 1, a portal frame design kiln of the known type comprises a number of metal portal frames 1 in the shape of inverted U's, consisting of a horizontal beam 11 and two feet 13. These portal frames 1 are positioned parallel to one another and constitute an external frame of the kiln that is designed to support the elements that constitute the chamber of the kiln.

Two portal frames 1 that are close to one another define among them a span 10 of the kiln.

Each horizontal beam 11 of the portal frame holds up, by the implementation of attachment means 12, a number of suspension parts 200 that are positioned beside one another.

Said suspension parts 200 constitute a horizontal support 2 that is similar to a small beam with a section in the shape of an inverted T. The sole plate 21 of such a support 2 is larger than the core 20 and, on both sides of this core 20, forms a bearing 23 that extends longitudinally over the entire length of said support 2.

Interjoists 3 that are parallelepipedic overall are positioned between two supports 2 that are close to one another by being oriented perpendicularly to said supports 2. Said interjoists that are shown in the drawing comprise projecting edges 32 that are mounted on opposite bearings 23 of the supports 2.

An insulating coating 34 covers the upper faces of the interjoists 3.

According to the invention, some interjoists 3 consist of a chimney block 4 with, viewed overall, a rectangular cross-section.

Said chimney blocks 4 replace the interjoists 3 and are positioned in the same way as the latter, beside one another in the width of the kiln, by being mounted on the bearings 23 of the supports 2.

Said chimney blocks 4 that are positioned beside one another in a span constitute a transverse pipe 45 that extends parallel to said supports 2.

As could be understood, said transverse pipe 45 that is produced by the invention forms a passage in which it is possible to circulate a gaseous fluid that is intended to improve the ventilation of the parts during firing.

The transverse pipe 45 extends over at least a portion of the length of the supports 2 between which it is positioned; its length is defined by the number of chimney blocks 4 positioned beside one another.

In the embodiment shown in the drawing, the chimney blocks 4 extend completely between the cores 20 of the supports 2 and above the sole plates 21 of said supports 2 so as to propose a pipe 45 of the largest section possible.

According to a variant embodiment not shown in the drawing, the chimney blocks 4 comprise a lower portion that extends between the sole plates 21.

Like the other elements of the roof, suspension parts 200 and interjoists 3, the chimney blocks 4 are made of refractory material.

Different types of chimney blocks 4 are provided so as to fulfill various functions in the ventilation system and constitute a family of elements among which the designer of the kiln selects based on the predetermined circulation of gaseous fluid that is supposed to be obtained.

Figure 2:
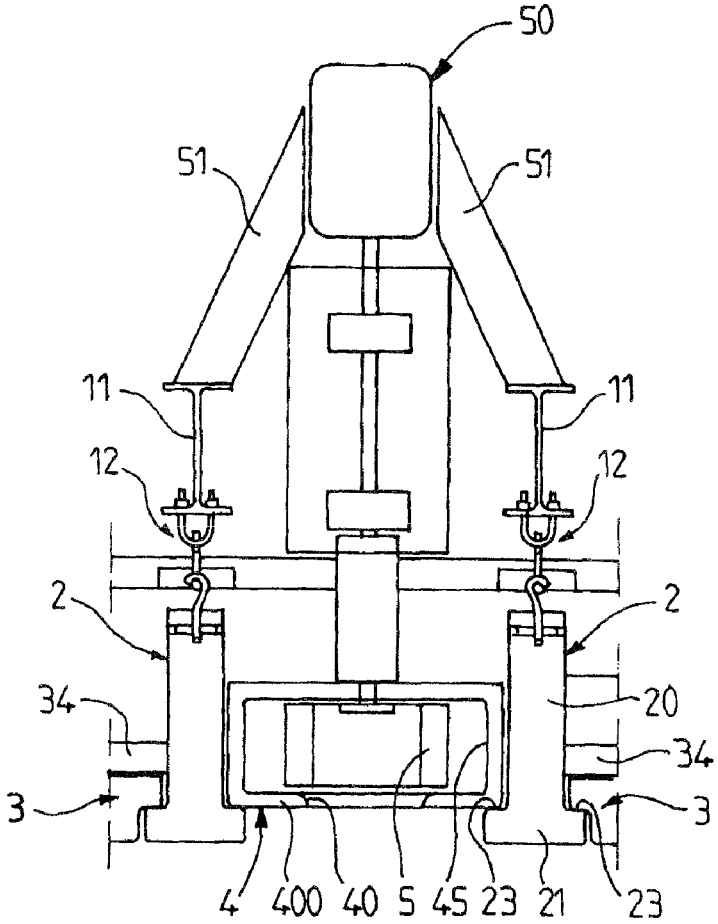
FIG. 2 is a view that is similar to FIG. 1 for a portal frame design kiln in which the invention is implemented according to a first embodiment, the section being made across a chimney-block-fan.

For example, the drawing shows a chimney-block-fan 400 in which a fan 5 is positioned, and said fan draws in or blows back the gas stream through an opening 40 of the lower face thereof that is turned toward the laboratory of the kiln, i.e., toward the space in which the products to be fired circulate. Said fan is entrained by means 50 that are shown diagrammatically in the drawing and held up by the portal frames 1 by the implementation of means 51. Two embodiments and forms of assembly of a fan are shown in FIGS. 2 and 3 by way of example.

Figure 3:
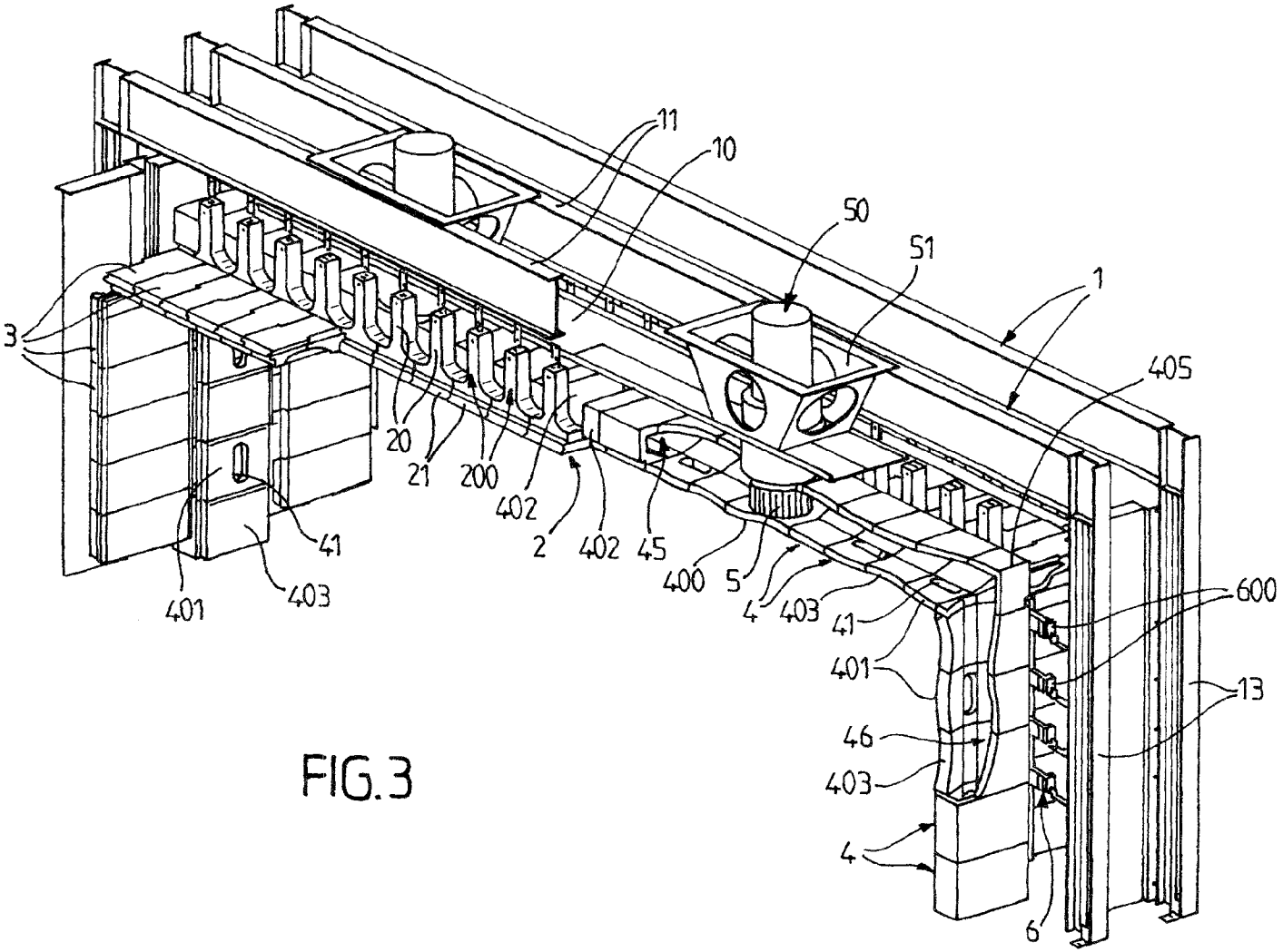
FIG. 3 is a partial perspective view of a portal frame design kiln in which the invention is implemented according to a second embodiment.

Distribution chimney blocks 401 are visible in FIG. 3; they have at least one orifice 41 in their lower face that is turned toward the laboratory of the kiln. In an embodiment that is not shown in the drawing, seals that can be controlled remotely are arranged in front of the orifices 41 of said distribution chimney blocks 401 so as to make possible the adjustment of the size of the free passage.

End chimney blocks 402 are also shown in the drawing; these chimney blocks 402 have an end that is closed by a transverse wall 42 that defines the end of the pipe 45.

Other chimney blocks can be added to this family, for example a simple chimney block 403 that constitutes a portion of transverse pipe 45 but does not have a particular element or a flap chimney block in which a flap, optionally adjustable from the outside, makes it possible to reduce the section of the transverse pipe 45.

The transverse pipe 45 that is formed by the chimney blocks 4 is used to draw in the gaseous fluid that is present in the laboratory of the kiln and to feed it back toward said laboratory at different points along said pipe.

The fan 5 is selected so as to draw in the gaseous fluid that is present in the laboratory through the opening 40 of the chimney-block-fan 400 and to feed it back via the openings 41 of the distribution chimney blocks 401, or vice versa.

Two or more portions of transverse pipe 45 are created, if necessary, in the same span by arranging end chimney blocks 402 at suitable locations along supports 2; a transverse pipe 45 in two parts is shown by way of example in FIG. 3.

As can be seen in the drawing and more specifically in FIG. 3, the lateral walls of the kiln have a constitution that is similar to that of the roof and comprise attaching parts 600 that are attached to the feet 13 of the portal frames 1 so as to constitute the vertical supports 6 between which are positioned interjoists 3 that are identical to those used in the roof.

According to the invention, in a span of the kiln, a vertical pipe 46 is formed in at least one longitudinal wall of the kiln and is connected, if necessary, to the transverse pipe 45 that is arranged in the same span.

A vertical pipe 46 is produced in the same manner as a transverse pipe 45 according to the invention by replacing the interjoists 3 of a span by chimney blocks 4 that are selected from among the family of chimney blocks based on the gaseous fluid circulation that is to be ensured.

A corner chimney block 405 ensures the connection between a transverse pipe 45 and a vertical pipe 46.

As could be understood, the implementation of chimney blocks 4 according to the invention makes it possible to regulate as well as possible the circulation of the gas streams around the parts to be treated by adapting the position of the openings in the transverse and/or vertical pipes.

Among the family of elements of chimney blocks, several distribution chimney blocks 401 whose opening or openings 41 have different sections can be proposed.

By way of example, openings 41 are positioned along vertical pipes 46 at selected heights so as to ensure a priority circulation of the gas streams at the load carried by the cars or at suitable zones provided in the lower spaces of said cars.

According to an embodiment of the invention, not shown in the drawing, the transverse pipes 45 and vertical pipes 46 are connected to external fluid distribution means and can then be used to draw off gaseous fluid that circulates in the kiln and to replace it by injecting air or any other gaseous fluid.

For certain types of firing, it is also possible to use these pipes for providing an injection of gaseous or solid products, etc.

The invention claimed is:

1. A portico furnace comprising:

a number of porticos (1) that are arranged in parallel to one another and that define the spans of the furnace, and supports (2, 6) that are attached to said porticos (1), between which are positioned interjoists (3) that constitute the walls of the furnace, wherein at least some of the interjoists (3) consist of a chimney block (4) with an axis that is parallel to said supports (2, 6), wherein said chimney blocks (4) are positioned beside one another in a span and constitute a transverse pipe (45) and/or a vertical pipe (46) extending parallel to said supports (2, 6).

2. The portico furnace according to claim 1, wherein said pipe (45) extends over at least a portion of the length of the supports (2, 6) between which it is positioned.

3. The portico furnace according to claim 2, wherein a transverse pipe (45) is connected to at least one vertical pipe (46).

4. The portico furnace according to claim 2, wherein the chimney block (4) has a rectangular cross-section.

5. The portico furnace according to claim 2, wherein said chimney blocks (4) are of different types, including: chimney-block-fan (400), distribution chimney block (401), end chimney block (402), simple chimney block (403), flap chimney block.

6. The portico furnace according to claim 1, wherein a transverse pipe (45) is connected to at least one vertical pipe (46).

7. The portico furnace according to claim 1, wherein the chimney block (4) has a rectangular cross-section.

8. The portico furnace according to claim 1, wherein said chimney blocks (4) are of different types, including: chimney-block-fan (400), distribution chimney block (401), end chimney block (402), simple chimney block (403), flap chimney block.

9. The portico furnace according to claim 1, wherein a corner chimney block (405) ensures the connection between the transverse pipe (45) and a vertical pipe (46).

10. A process for ventilation of a portico furnace according to claim 1, wherein:

Transverse pipes (45) and/or vertical pipes (46) are formed in at least some of the spans of the furnace by positioning interjoists in the form of a chimney block (4), A gaseous fluid is circulated between the chamber of the furnace and said transverse pipes (45) and/or vertical pipes (46).

11. The process for ventilation of a portico furnace according to claim 10, wherein a predetermined circulation of the gaseous fluid is obtained by selecting the chimney blocks that are designed to constitute each pipe (45, 46) among a family that comprises, for example, chimney-block-fans (400), distribution chimney blocks (401), end chimney blocks (402), simple chimney blocks (403), flap chimney blocks, corner chimney blocks (405) . . . .

12. The process for ventilation of a portico furnace according to claim 11, wherein at least some of the transverse pipes and/or vertical pipes are connected to external fluid distribution means.

13. The process for ventilation of a portico furnace according to claim 10, wherein at least some of the transverse pipes and/or vertical pipes are connected to external fluid distribution means.

14. A portico furnace comprising:

a number of porticos (1) that are arranged in parallel to one another and that define the spans of the furnace, and supports (2, 6) that are attached to said porticos (1), between which are positioned interjoists (3) that constitute the walls of the furnace, wherein at least some of the interjoists (3) consist of a chimney block (4) with an axis that is parallel to said supports (2, 6), wherein:

Transverse pipes (45) and/or vertical pipes (46) are formed in at least some of the spans of the furnace by positioning interjoists in the form of a chimney block (4), A gaseous fluid is circulated between the chamber of the furnace and said transverse pipes (45) and/or vertical pipes (46).

15. The process for ventilation of a portico furnace according to claim 14, wherein a predetermined circulation of the gaseous fluid is obtained by selecting the chimney blocks that are designed to constitute each pipe (45, 46) among a family that comprises, for example, chimney-block-fans (400), distribution chimney blocks (401), end chimney blocks (402), simple chimney blocks (403), flap chimney blocks, corner chimney blocks (405).

16. The process for ventilation of a portico furnace according to claim 15, wherein at least some of the transverse pipes and/or vertical pipes are connected to external fluid distribution means.

17. The process for ventilation of a portico furnace according to claim 14, wherein at least some of the transverse pipes and/or vertical pipes are connected to external fluid distribution means.

* * * * *